United States Patent [19]

Simmons, Jr.

[11] 4,387,618

[45] Jun. 14, 1983

[54] HARMONY GENERATOR FOR ELECTRONIC ORGAN

[75] Inventor: Carlton J. Simmons, Jr., Florence, Ky.

[73] Assignee: Baldwin Piano & Organ Co., Cincinnati, Ohio

[21] Appl. No.: 158,585

[22] Filed: Jun. 11, 1980

[51] Int. Cl.[3] ..... G10F 1/00; G10H 3/06

[52] U.S. Cl. ..... 84/1.03; 84/1.17; 84/DIG. 22; 84/DIG. 2

[58] Field of Search ..... 84/1.01, 1.03, 1.24, 84/1.17, DIG. 2, DIG. 22

[56] References Cited

U.S. PATENT DOCUMENTS

| | | | |
|---|---|---|---|
| 4,187,756 | 2/1980 | Robinson et al. | 84/1.03 |
| 4,197,777 | 4/1980 | Wheelwright et al. | 84/1.03 |
| 4,205,576 | 6/1980 | Deutsch et al. | 84/1.17 |
| 4,228,714 | 10/1980 | Howell | 84/1.24 |

*Primary Examiner*—J. V. Truhe
*Assistant Examiner*—Forester W. Isen
*Attorney, Agent, or Firm*—Kirkland & Ellis

[57] ABSTRACT

A harmony generator for an electronic organ, wherein the identity of played keys of the keyboard(s) is read into a storage device and then operated upon by a data processing device such as a microcomputer, so as to supplement the played note data with additional data designating "fill-in" notes which are to be sounded in addition to those actually played. The data contained in the storage device, as supplemented, is then used to control the transmission of tone generator signals to the audio output system of the organ. In a preferred embodiment of the invention, the criteria used to select fill-in notes cause notes corresponding to the nomenclatures of played notes of the accompaniment keyboard to be sounded as though played in the octave below the lowest note played on the solo keyboard. Other fill-in criteria are also contemplated. The fill-in notes are generated by combining played accompaniment data with masks. The identity of these masks is based upon the nomenclature of the lowest or highest played note of the solo keyboard. These masks can either be looked up in a table or generated by a suitable algorithm. Fill-in notes can be generated simultaneously by more than one set of criteria, and the fill-in notes so produced can be separately voiced.

22 Claims, 8 Drawing Figures

96
$Q_0$ $Q_1$ $Q_2$ $Q_3$ $Q_4$ $Q_5$ $Q_6$ $Q_7$
D
L A T C H
$A_\phi$ $A_1$ $A_2$ E
DATA LINE FROM I/O PORT
131N
80
72M
92MN LOWEST PLAYED SOLO NOTE
REG 0
REG 1
REG 2
REG 3
$A^3$ $A\#^3$ $B^3$ $C^4$ $C\#^4$ $D^4$ $D\#^4$ $E^4$ $F^4$ $F\#^4$ $G^4$ $G\#^4$ $A^4$ $A\#^4$ $B^4$ $C^5$ $C\#^5$ $D^5$ $D\#^5$ $E^5$ $F^5$ $F\#^5$ $G^5$ $G\#^5$ $A^5$ $A\#^5$ $B^5$ $C^6$ $C\#^6$ $D^6$ $D\#^6$ $E^6$
REGISTER 14
REGISTER 10
REGISTER 13
REGISTER 10
14

FIG-6

| REGISTER | BIT 7 | 6 | 5 | 4 | 3 | 2 | 1 | 0 | REGISTER TYPE | |
|---|---|---|---|---|---|---|---|---|---|---|
| 20 | $F_3$ | $F^{\#}_3$ | $G_3$ | $G^{\#}_3$ | $A_3$ | $A^{\#}_3$ | $B_3$ | $C_4$ | H | SOLO NOTES |
| 21 | $F_4$ | $F^{\#}_4$ | $G_4$ | $G^{\#}_4$ | $A_4$ | $A^{\#}_4$ | $B_4$ | $C_5$ | H | |
| 22 | $F_5$ | $F^{\#}_5$ | $G_5$ | $G^{\#}_5$ | $A_5$ | $A^{\#}_5$ | $B_5$ | $C_6$ | H | |
| 23 | $F_6$ | $F^{\#}_6$ | $G_6$ | $G^{\#}_6$ | $A_6$ | $A^{\#}_6$ | $B_6$ | $C_7$ | H | |
| 24 | | | | | $C^{\#}_4$ | $D_4$ | $D^{\#}_4$ | $E_4$ | L | |
| 25 | | | | | $C^{\#}_5$ | $D_5$ | $D^{\#}_5$ | $E_5$ | L | |
| 26 | | | | | $C^{\#}_6$ | $D_6$ | $D^{\#}_6$ | $E_6$ | L | |
| 27 | $F_2$ | $F^{\#}_2$ | $G_2$ | $G^{\#}_2$ | $A_2$ | $A^{\#}_2$ | $B_2$ | $C_3$ | H | ACCOMPANIMENT NOTES |
| 28 | $F_3$ | $F^{\#}_3$ | $G_3$ | $G^{\#}_3$ | $A_3$ | $A^{\#}_3$ | $B_3$ | $C_4$ | H | |
| 29 | $F_4$ | $F^{\#}_4$ | $G_4$ | $G^{\#}_4$ | $A_4$ | $A^{\#}_4$ | $B_4$ | $C_5$ | H | |
| 30 | $F_5$ | $F^{\#}_5$ | $G_5$ | $G^{\#}_5$ | $A_5$ | $A^{\#}_5$ | $B_5$ | $C_6$ | H | |
| 31 | | | | | $C^{\#}_3$ | $D_3$ | $D^{\#}_3$ | $E_3$ | L | |
| 32 | | | | | $C^{\#}_4$ | $D_4$ | $D^{\#}_4$ | $E_4$ | L | |
| 33 | | | | | $C^{\#}_5$ | $D_5$ | $D^{\#}_5$ | $E_5$ | L | |
| 34 | 0 | 0 | 0 | 0 | 0 | 0 | 0 | 0 | H | MASKS: LPSN |
| 35 | | | | | 1 | 1 | 0 | 0 | L | |
| 36 | 0 | 1 | 1 | 1 | 1 | 1 | 1 | 1 | H | MASKS: LPSN-1 |
| 37 | | | | | 0 | 0 | 0 | 0 | L | |
| 38 | 0 | 0 | 1 | 0 | 0 | 0 | 1 | 0 | H | LOGICAL OR OF ACCOMPANIMENT NOTE DATA |
| 39 | | | | | 0 | 1 | 0 | 0 | L | |

HARMONY GENERATOR FOR ELECTRONIC ORGAN

BACKGROUND OF THE INVENTION

1. Field of the Invention

The present invention relates to an improved mechanism for generating harmony in an electronic organ, and more particularly, pertains to an organ system controlled by digital logic circuitry wherein played notes of the accompaniment keyboard can be automatically octavely rearranged so as to be positioned in a specified relationship to the lowest note played on the solo manual.

2. Description of the Prior Art

A variety of devices for generating harmony or other fill-in notes are known in the prior art. For example, U.S. Pats. No. 3,240,857—Munch U.S. Pat. No. 3,470,306—Hadden, U.S. Pat. No. 3,509,262—Munch, U.S. Pat. No. 3,558,794—Hadden, all assigned to the same assignee as the present invention, all disclose systems which generate notes associated with the pedal division of an organ based upon keys played on the accompaniment manual of the organ. These systems accomplish this result variously by means of arrays of multiple contact switches, preference circuitry, and frequency dividers. A similar system is disclosed in U.S. Pat. No. 3,565,995—Bunger, assigned to the same assignee as the present invention, which pertains to a system for causing played accompaniment notes to be sounded through the filters associated with the solo keyboard by means of FET gates under the control of DC circuitry which is triggered by the playing of a key on the solo manual.

In addition, for example, U.S. Pat. No. 3,929,051 to Moore, et al. discloses a system which uses time division multiplexing to transmit key switch information to appropriate tone generators. The Moore system generates harmony notes by producing "supplementary" pulses on the signal which carries Moore's key switch information. These pulses are added to the signal by passing through an electronic window when a pulse associated with a played accompaniment note coincides with the window. U.S. Pat. No. 3,283,056 to Cookerly, and U.S. Pat. No. 3,247,310 to Stinson both disclose devices for generating fill-in notes via an array of ganged switches which are disposed between the tone signal sources and the output system. The playing of a solo key closes one or more switches which enable a section of the solo keyboard, and the playing of an accompaniment key causes one or more of the enabled solo notes to sound.

Copending application, Ser. No. 40,107, filed May 18, 1979, for "Automatic Control Apparatus For Chords And Sequences," issued into U.S. Pat. No. 4,292,874 on Oct. 6, 1981(assigned to the same assignee as the present invention) shows an apparatus for generating chords and sequences based upon a single tonic note selected by the instrumentalist, using stored digital representations of the tonic note and the chords and sequences. However, this apparatus does not generate fill-in notes based on certain played notes for sounding in a position dependent upon other played notes.

Thus, none of the prior art systems uses digital storage of played key data to generate fill-in notes responsive to at least two played keys.

SUMMARY OF THE INVENTION

The present invention relates to an improved device for generating "fill-in" notes in an electronic musical instrument. Such fill-in notes are in addition to the notes corresponding to keys which are actually played, and they are selected in accordance with criteria chosen to provide an enhanced musical effect. In the principal preferred embodiment of the present invention (referred to as the "Pro" feature), the fill-in notes are selected to correspond to the nomenclatures or note names of notes played on the accompaniment keyboard (or the left-hand portion of the keyboard in a single keyboard instrument embodiment), and the fill-in notes are sounded as though played in the octave below the lowest note played on the solo keyboard (or the right-hand portion of the keyboard in a single keyboard instrument embodiment). In addition, the two notes immediately below the lowest played solo note (i.e. the top two notes of the fill-in octave) can be suppressed to avoid the proximity dissonance which might result if a note were filled in close to the lowest played solo note. Other criteria for the selection of these fill-in notes are also contemplated by the present invention as described below.

The present invention accomplishes this result on a musical instrument controlled by digital logic circuitry such as a microprocessor. The microprocessor includes a random acccess memory, a portion of which is used to store information regarding the identity of notes to be sounded by the organ. The microprocessor stores a "1" in its memory at the location allocated to a particular note if the key on the keyboard corresponding to that note is actuated, and a "0" in the memory location corresponding to each key on the keyboard which is not actuated. The status of the various keys of the keyboard (as well as the status of stop control switches and mode selector switches) is ascertained by scanning the status of these keys and switches, and loading this information into designated portions of the memory. This operation is performed under the contrrol of the digital logic circuitry, and at intervals selected so as to eliminate any audible delay in the response of the instrument to a change in the status of a key or switch.

Several methods for generating the fill-in notes are contemplated within the scope of the present invention. In the preferred embodiment of the present invention, the played key data is loaded into the portion of the memory which is used to store information regarding notes to be sounded. This data is then manipulated to generate additional data in the form of "1's" and "0's" which define the notes to be filled-in. This data is then added to the note played information stored in the memory, and the result represents the notes to be sounded. Signal generators are then assigned to produce tones corresponding to notes to be sounded (i.e., the notes played plus the notes to be filled-in) and these tones are transmitted to an appropriate output system.

Accordingly, it is a principal object of the present invention to provide an improved device for generating fill-in notes for an electronic musical instrument, particularly an electronic organ.

A further object of the present invention is to provide a device for generating fill-in notes wherein the criteria for the fill-in notes are readily modifiable.

Another object of the present invention is to provide a means for generating fill-in notes which is suited for use in conjunction with a microprocessor controlled organ system or any organ system wherein data regarding notes to be sounded is stored in a memory device.

These and other objects, advantages and features are hereinafter set forth, and for purposes if illustration but not limitation, certain preferred embodiments of the present invention are hereinafter described and illustrated in the accompanying drawings.

BRIEF DESCRIPTION OF THE DRAWINGS

FIG. 6 is a table showing the data storage format in the 8-bit embodiment of the present invention.

DETAILED DESCRIPTION OF THE PREFERRED EMBODIMENTS

Figure 1:
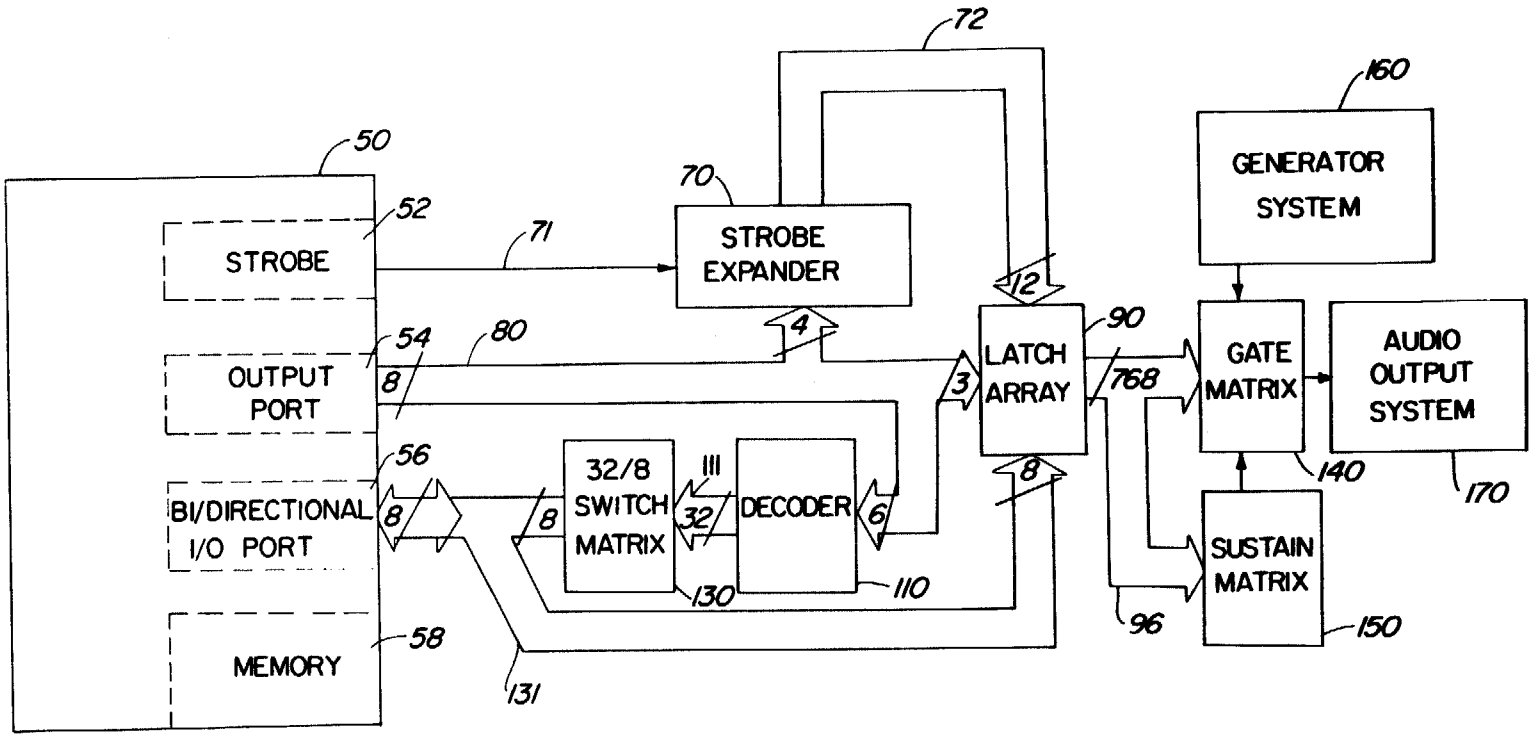
FIG. 1 is a block diagram of an organ system which is under the control of an 8--bit microprocessor, in accordance with one embodiment of the present invention.

As shown in FIG. 1, microprocessor 50 includes a strobe 52, an output port 54, a bidirectional input/output port ("I/O port") 56, and a random access memory 58. For clarity, other conventional features of the microprocessor 50 are not shown. Strobe 52 of microprocessor 50 is connected to strobe expander 70 by a line 71. Output bus 80 connects the output port 54 of microprocessor 50 to the rest of the organ system via the eight lines which comprise output bus 80 as follows: four lines of output bus 80 are connected to strobe expander 70; three lines of output bus 80 are connected to latch array 90; and six lines of output bus 80 are connected to decoder 110. Five of the six lines connected to decoder 110 are also connected to strobe expander 70 or latch array 90. However this does not present a problem because, as described below, the strobe expander 70 and latch array 90 are only addressed during operations affecting the output system (i.e., the gate matrix 140 and sustain matrix 150) whereas the decoder 110 is only addressed when the status of the switches in switch matrix 130 is being read into the memory 58 of microprocessor 50. Decoder 110 is connected to switch matrix 130 by decoder bus 111 which comprises 32 lines which are addressed sequentially by decoder 110. Each of the 32 lines 111 addresses eight switches of the switch matrix and the status of the 32 sets of eight switches per set is thereby read into microprocessor 50 via the eight lines of I/O bus 131, as a series of 32 8-bits words. In this manner, the microprocessor 50 ascertains the condition of each of the switches in the switch matrix 130. The switch matrix 130 includes a switch for each key of the keyboard(s) (not shown) as well as each of the stop switches (i.e., voice selection controls—not shown) and function selection switches (e.g., automatic fill-in, automatic chording, and sustain—not shown). This information is read into the microprocessor 50 for further processing in accordance with the instructions called for by the switches.

In particular, in the automatic fill-in mode, the status of all keys of the keyboard is stored in a designated portion of memory 58 (represented schematically in FIG. 6). As described in detail below, the microprocessor 50 then operates on this data to generate fill-in notes which are stored along with played notes in the memory 58. This combined information represents the notes to be sounded by the organ.

Figure 2:
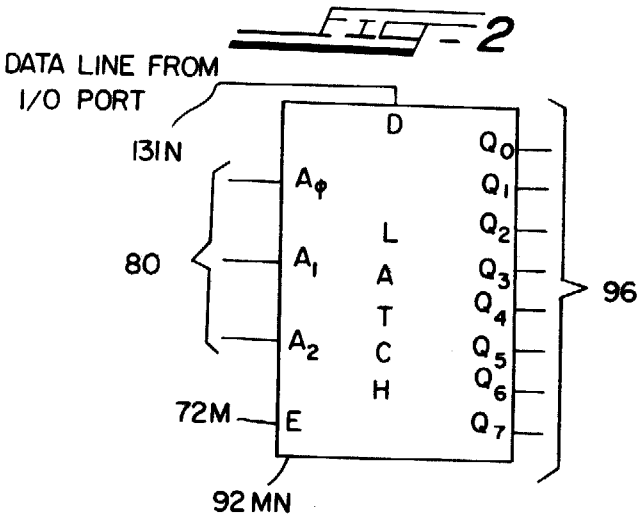
FIG. 2 is a wiring diagram for a typical latch of the latch array used in one embodiment of the present invention.

Once the notes to be sounded have been determined, this data is transmitted to the gate matrix 140 as follows. The strobe 52 transmits sequential timing pulses via line 71 to strobe expander 70. The four lines of output bus 80 which are connected to strobe expander 70 address one of the twelve outputs of the strobe expander 70 so that the strobe pulses are transmitted to latch array 90 on the selected one of the twelve lines of the strobe bus 72. Latch array 90 includes 96 latches 92, arranged in twelve sets of 8 latches per set. A typical latch 92-MN of latch array 90 is shown in FIG. 2. The enable lead "E" of latch 92-MN is connected to strobe output line 72-M, which is the Mth one of the twelve lines of strobe output bus 72. Similarly, the data lead "D" of latch 92-MN is connected to line 131-N which is the Nth one of the eight lines of I/O bus 131. The three latch inputs 80 receive an address from microprocessor 50 via output bus 80 which selects one of the eight latch outputs 96. When the enable lead E of latch 92-MN is pulsed by the strobe expander output on strobe output bus line 72-M, the data on line 131-N of I/O bus 131 is outputted on whichever one of the eight output leads 96 has been addressed.

Each of the 8 latches in the Mth set (i.e., latches 92-M1 to 92-M8) is connected to line 72-M of strobe output bus 72, so that these latches are simultaneously enabled when the address read into the strobe expander 70 selects liens 72-M. Since the data input of each of the 8 latches 92-M1 to 92-M8 is connected to a different one of the eight lines 131-1 to 131-8 of I/O bus 131, each pulse on a line 72-M of the strobe output bus 72 causes an 8-bit word to be read into the 8 latches 92-M1 to 92-M8 from the microprocessor 50. As stated above, this 8-bit word is transmitted to the latch outputs 96 which are selected by the three bit address from the output bus 80.

The latch outputs 96 are in turn connected to the gate matrix 140 and the sustain matrix 150, which control the transmission of generator signals from the generator system 160 to the audio output system 170. In this manner, the microprocessor 50 controls the state of each of the 96 latches 92 in which in turn have eight outputs each. Thus, the microprocessor 50 can control a total of up to 768 gates in the gate matrix 140 and the sustain matrix 150. These gates are used to select frequency generators, filters and other circuitry so as to produce sound in accordance with the keys and functions selected by the user of the instrument. It should be noted that since the microprocessor 50 controls the various inputs to the latch array 90 (i.e., the address applied to the latches 92, the data input to the latches 92, and which of the lines of the strobe output bus 72 is pulsed), the microprocessor 50 can signal individual gates of the gate matrix 140 and the sustain matrix 150, in any desired sequence, and as necessary to update gate status, without counting through all 768 outputs of latch array 90.

Both the generator system 160 and the audio output system 170 are well known in the art. A generator system 160, gate matrix 140 and sustain matrix 150 which are suited to use in conjunction with the present invention are described in co-pending application Ser. No. 163,409 filed June 26, 1980 entitled "Electronic Organ Having an Improved Tone Generator System," and assigned to the same assignee as the present invention.

The most simple embodiment of the present invention would utilize a 12-bit microprocessor. A twelve bit machine is desirable because there are twelve notes to a musical octave, and accordingly, manipulation of musical data is simplified. However, 12-bit machines present certain practical problems, principally due to their limited commercial acceptance. Therefore, two embodiments of the present invention which are designed for use with 8-bit microprocessors will be described, as well as a 12-bit version.

Figure 3:
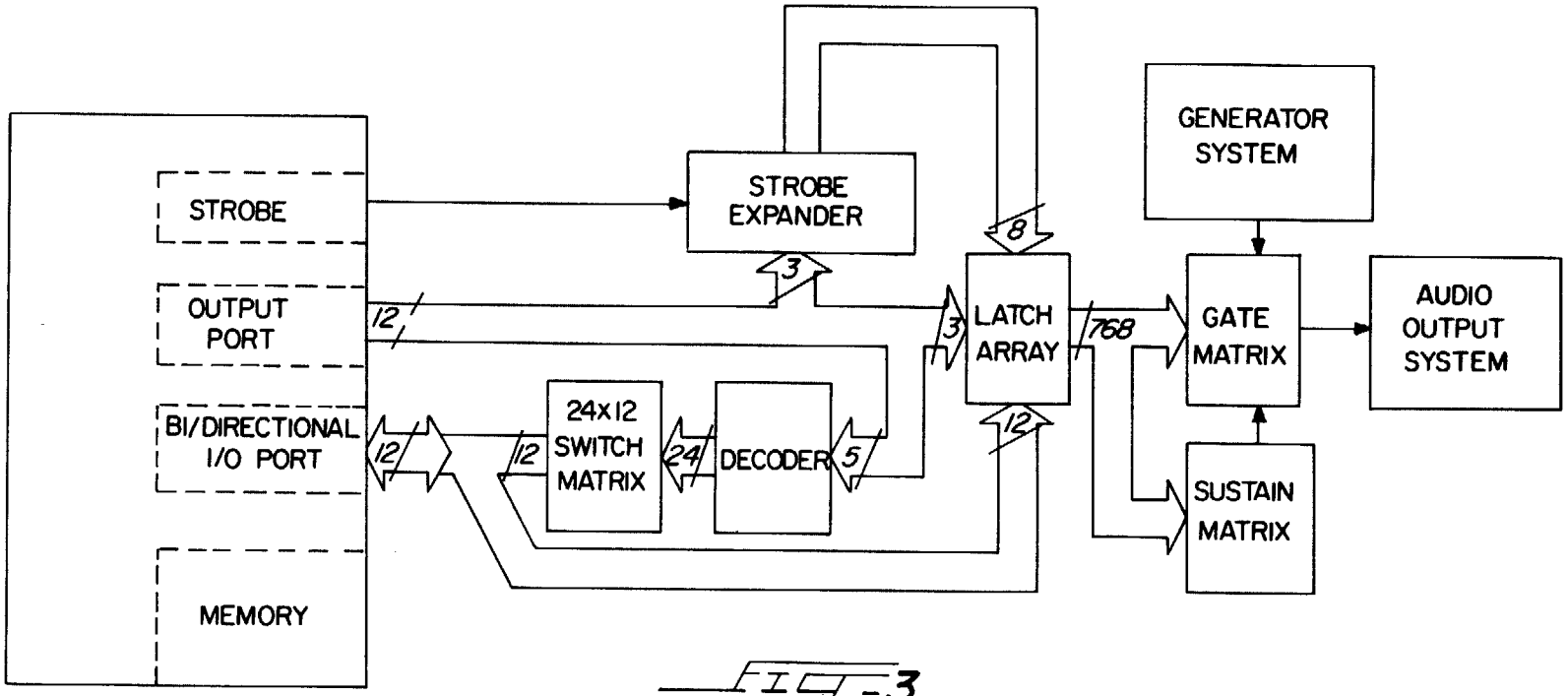
FIG. 3 is a schematic diagram of an electronic organ controlled by a 12-bit microprocessor in accordance with an alternative embodiment of the present invention.

Using the same basic structure as shown in FIG. 1, a 12-bit machine shown in FIG. 3 would scan the keys of the organ and read in the status of the keys of the keyboard on octave at a time. Assuming two 44 note manuals, the played key data can be stored in ten 12-bit registers as follows:

TABLE 1

| Register Number | Bit 11 | 10 | 9 | 8 | 7 | 6 | 5 | 4 | 3 | 2 | 1 | 0 |
|---|---|---|---|---|---|---|---|---|---|---|---|---|
| #0 | 0 | 0 | 0 | 0 | 0 | $F_3$ | $F\#_3$ | $G_3$ | $G\#_3$ | $A_3$ | $A\#_3$ | $B_3$ |
| #1 | $C_4$ | $C\#_4$ | $D_4$ | $D\#_4$ | $E_4$ | $F_4$ | $F\#_4$ | $G_4$ | $G\#_4$ | $A_4$ | $A\#_4$ | $B_4$ |
| #2 | $C_5$ | $C\#_5$ | $D_5$ | $D\#_5$ | $E_5$ | $F_5$ | $F\#_5$ | $G_5$ | $G\#_5$ | $A_5$ | $A\#_5$ | $B_5$ |
| #3 | $C_6$ | $C\#_6$ | $D_6$ | $D\#_6$ | $E_6$ | $F_6$ | $F\#_6$ | $G_6$ | $G\#_6$ | $A_6$ | $A\#_6$ | $B_6$ |
| #4 | $C_7$ | 0 | 0 | 0 | 0 | 0 | 0 | 0 | 0 | 0 | 0 | 0 |
| #5 | 0 | 0 | 0 | 0 | 0 | $F_2$ | $F\#_2$ | $G_2$ | $G\#_2$ | $A_2$ | $A\#_2$ | $B_2$ |
| #6 | $C_3$ | $C\#_3$ | $D_3$ | $D\#_3$ | $E_3$ | $F_3$ | $F\#_3$ | $G_3$ | $G\#_3$ | $A_3$ | $A\#_3$ | $B_3$ |
| #7 | $C_4$ | $C\#_4$ | $D_4$ | $D\#_4$ | $E_4$ | $F_4$ | $F\#_4$ | $G_4$ | $G\#_4$ | $A_4$ | $A\#_4$ | $B_4$ |
| #8 | $C_5$ | $C\#_5$ | $D_5$ | $D\#_5$ | $E_5$ | $F_5$ | $F\#_5$ | $G_5$ | $G\#_5$ | $A_5$ | $A\#_5$ | $B_5$ |
| #9 | $C_6$ | 0 | 0 | 0 | 0 | 0 | 0 | 0 | 0 | 0 | 0 | 0 |

A "1" is stored in the position identified in Table 1 for each played note, and a "0" is stored in the position identified in Table 1 for each note which is not played.

As previously described, it is the object of the "Pro" feature of the present invention to provide fill-in notes corresponding to the nomenclatures of played accompaniment notes, and to sound as if played in the octave below the lowest played solo note. Accordingly, it is necessary to identify the nomenclatures of all played accompaniment notes, and to identify the lowest played solo note.

The nomenclatures of the played accompaniment notes are determined by simply ORing the accompaniment registers (i.e., registers 5 through 9 of Table 1) together. The result is stored in register #10. If, for example, the notes G3, B3, and D4 were played on the accompaniment manual, register 10 would appear as follows:

| | 11 | 10 | 9 | 8 | 7 | 6 | 5 | 4 | 3 | 2 | 1 | 0 |
|---|---|---|---|---|---|---|---|---|---|---|---|---|
| Req. 10 | 0 | 0 | 1 | 0 | 0 | 0 | 0 | 1 | 0 | 0 | 0 | 1 |

The lowest played solo note is identified by searching the solo keyboard (i.e.; registers 0 through 4 of Table 1) in bit order starting with the lowest note (i.e., bit 11 of register 0). For example, if the lowest played solo note was F5, the note F5 is identified as bit #6 of register #2. A bit pointer is then established with bit 6 equal to one and all other bits equal to zero. This pointer is stored in register 11:

| | 11 | 10 | 9 | 8 | 7 | 6 | 5 | 4 | 3 | 2 | 1 | 0 |
|---|---|---|---|---|---|---|---|---|---|---|---|---|
| Req. 11 | 0 | 0 | 0 | 0 | 0 | 1 | 0 | 0 | 0 | 0 | 0 | 0 |

A register pointer is established to identify the register of the lowest played solo note, and this pointer is stored in register 12 (in binary ):

| | 11 | 10 | 9 | 8 | 7 | 6 | 5 | 4 | 3 | 2 | 1 | 0 |
|---|---|---|---|---|---|---|---|---|---|---|---|---|
| Req. 12 | 0 | 0 | 0 | 0 | 0 | 0 | 0 | 0 | 0 | 0 | 1 | 0 |

The information stored in registers 10, 11, and 12 is used to compute two masks. The first mask (which will be stored in register 13) will be used to select the accompaniment tones which will be inserted into the same register (i.e., the same C to B octave) as the register containing the lowest played solo note (register 2 in the example). The second mask (which will be stored in register 14) will be used to select the accompaniment tones which will be inserted into the register for the next lower octave (i.e., the C to B octave below the octave containing the lowest solo note, which would be register 1 in the example).

Figure 4:
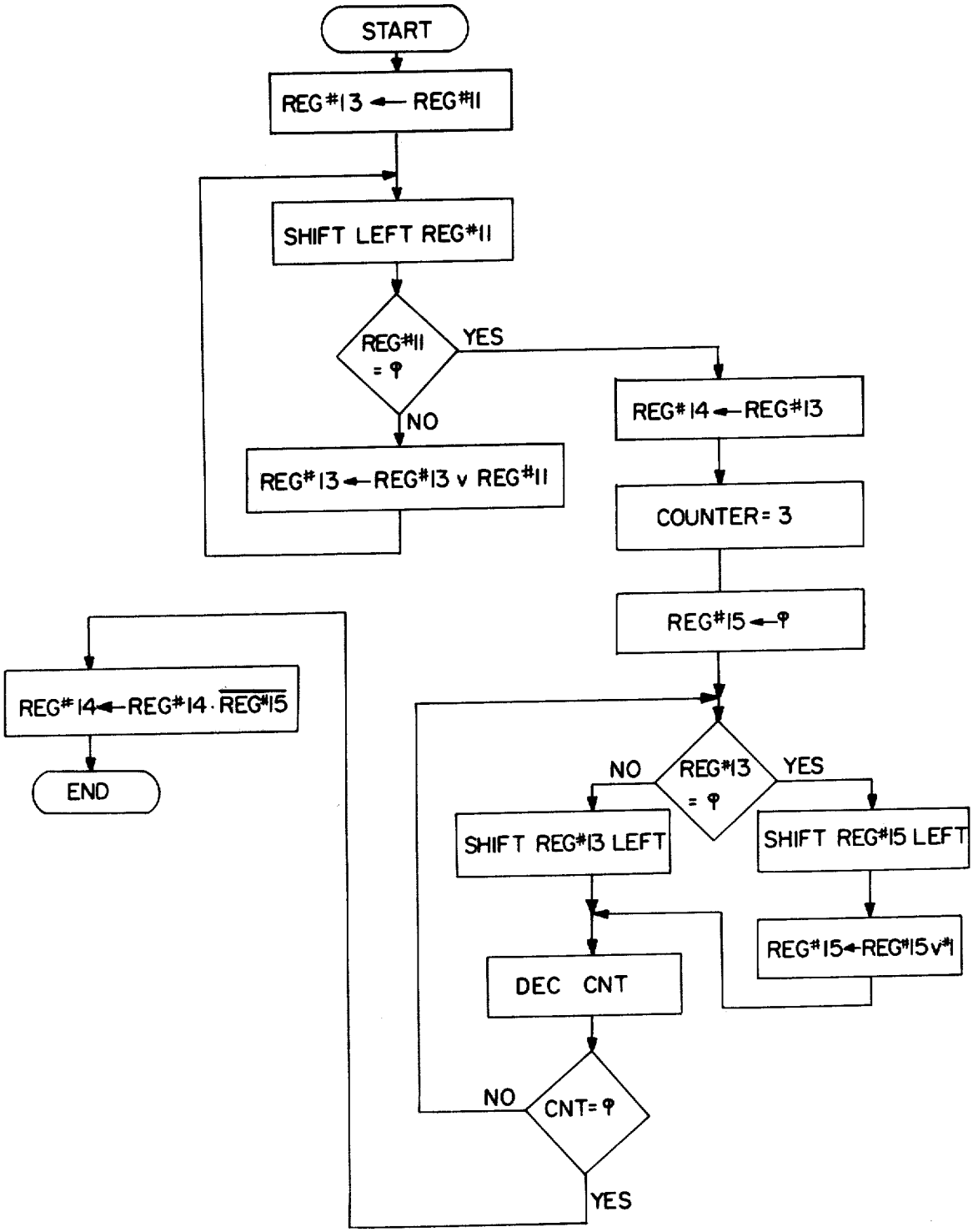
FIG. 4 is a flow chart showing one method of generating the masks necessary for the 12-bit embodiment of present invention.

The masks are generated in accordance with the flow chart shown in FIG. 4. The pointer in register 11 is transferred to register 13. Register 11 is then shifted left. If register 11 is not equal to zero, register 11 is ORed into register 13, and register 11 is shifted left again. This continues until register 11 equals zero. When register 11 equals zero, the complement of register 13 is inserted in register 14, a counter is set to "3", and register 15 is initialized to "0".

Figure 5:
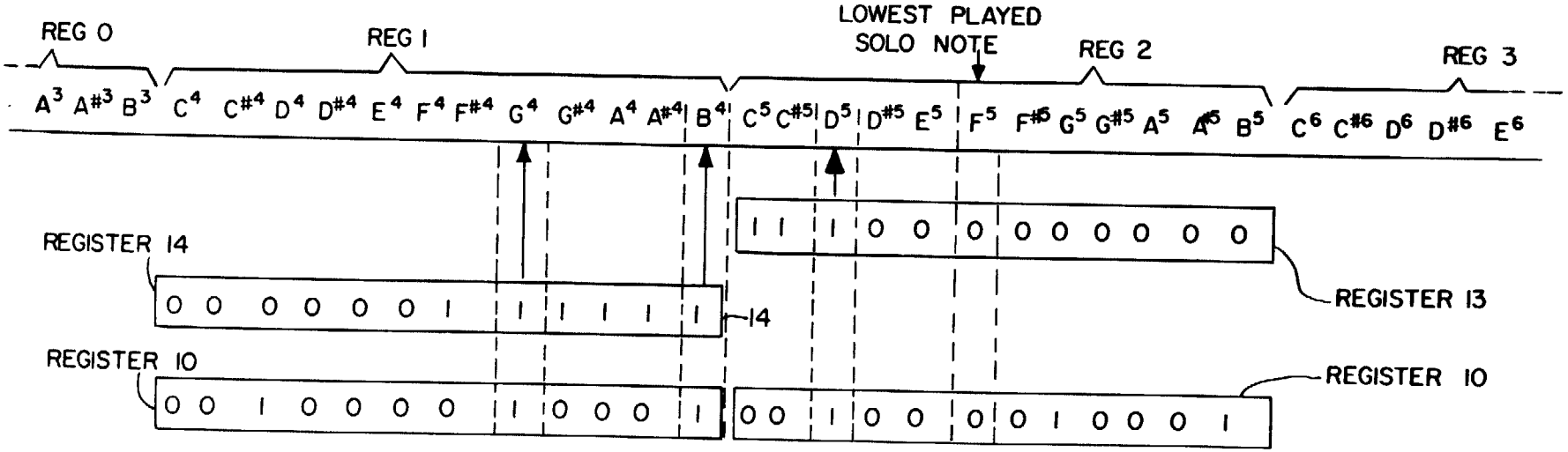
FIG. 5 illustrates the interrelationship between certain of the masks and registers used in the 12-bit embodiment of the present invention.

If register 13 is equal to zero, register 15 is shifted left and ORed with "1". If register 13 is not equal to zero, register 13 is shifted left. In either case, the counter is decremented and register 13 is checked again. If register 13 is zero, register 15 is shifted left and ORed with "1"; if not, register 13 is shifted left. This process continues until the counter is equal to zero, whereupon the complement of register 15 is ANDed into register 14. The masks, as shown in FIG. 5, are then complete.

In the embodiment described above, the two notes immediately below the lowest played solo note have been suppressed. This has been done by shifting register 13 left (if register 13 is not zero), and ANDing the complement of register 15 into register 14 (to cover the possibility that register 13 is zero). As discussed above, this is done to avoid proximity dissonance between played solo notes and fill-in notes. Of course the size of the buffer between the lowest played solo note and the highest fill-in note is selectable based on the value initialized into the counter of FIG. 4. It can be seen by inspection that the two masks thus generated in registers 13 and 14 serve to identify the range of the solo keyboard in which the accompaniment notes are to be filled-in.

The masks in registers 13 and 14 are then combined with the played key data as follows. The accompaniment note data in register 10 is ANDed into the first mask (register 13) and the result is ORed with the played solo key data contained in the register which contains the lowest played solo note, i.e., the register pointed to by the register pointer in register 12 (register 2 in the example). Similarly, the accompaniment note data in register 10 is ANDed into the second mask (register 14), and the result is ORed with the register below the register containing the lowest played solo note, i.e., the register corresponding to the register pointer in register twelve, minus 1 (register 1 in the example).

The result of this operation is that 1's (designating notes to be sounded) have been inserted into registers in the memory 58 of microprocessor 50 to identify the notes meeting the fill-in criteria (i.e., those notes which correspond to the nomenclatures of played keys of the accompaniment keyboard, and which fall into the octave below the lowest played solo note, exclusive of the two tones immediately below the lowest played solo note - G4, B4, and D5 in the example) as notes "to be sounded." The microprocessor 50 causes the notes which are to be sounded to be transferred to the audio output system in the manner described above in connection with FIGS. 1 and 2, and as described in copending application Ser. No. 163,409, filed June 26, 1980 entitled "Electronic Organ Having an Improved Tone Generator System," and assigned to the same assignee as the present invention.

Two embodiments of an 8-bit version of the present invention will be discussed. The first, and simpler version obtains the masks which are the 8-bit counterparts to registers 13 and 14 of the 12-bit embodiment from a table indexed by the nomenclature of the lowest played solo note. The second embodiment generates the 8-bit masks from an algorithm.

In an 8-bit machine, it is not possible to store the status of an entire octave in a single word of memory since twelve bits must be stored. Accordingly, each octave is broken into two parts, and is stored in the format shown in FIG. 6. The type H register stores 8 notes and the type L register stores 4 notes. The remaining 4 bits of the type L register can be used for storage or transfer of other data, as appropriate. Three masks are necessary in the 8-bit embodiment of the present invention in order to implement the fill-in criteria set forth above for an arbitrary lowest played solo note. If the lowest played solo note is identified by a bit in a type L register (i.e. if the lowest played solo note is a C#, D, D#, or E), there must be an L register mask for the register which includes the lowest played solo note, and an H and L register masks for the registers of the full C# to C octave below the lowest played solo note. Conversely, if the lowest played solo note is identified by a bit in a type H register (i.e. if the lowest played solo note is an F, F#, G . . . C), there must must be H and L register masks for the registers associated with the C# to C octave which includes the lowest played solo note, and an H register mask for the register associated with the eight highest notes of the next lower actave.

With this arrangement, masks are always generated for the full octave below the lowest played solo note. The masks necessary to identify the particular accompaniment notes which should be filled in in accordance with the fill-in criteria set forth above and be tabulated as shown in Table 2:

TABLE 2

| Lowest Played Solo Note | | Register Number | Mask Type | Octave | Mask |
|---|---|---|---|---|---|
| C# | Mask 1 | 35 | L | LPSN* | 00000000 |
| | Mask 2 | 36 | H | LPSN-1** | 11111100 |
| | Mask 3 | 37 | L | LPSN-1 | 00000111 |
| D | Mask 1 | 35 | L | LPSN | 00000000 |
| | Mask 2 | 36 | H | LPSN-1 | 11111110 |
| | Mask 3 | 37 | L | LPSN-1 | 00000011 |
| D# | Mask 1 | 35 | L | LPSN | 00000000 |
| | Mask 2 | 36 | H | LPSN-1 | 11111111 |
| | Mask 3 | 37 | L | LPSN-1 | 00000001 |
| E | Mask 1 | 35 | L | LPSN | 00001000 |
| | Mask 2 | 36 | H | LPSN-1 | 11111111 |
| | Mask 3 | 37 | L | LPSN-1 | 00000000 |
| F | Mask 1 | 34 | H | LPSN | 00000000 |
| | Mask 2 | 35 | L | LPSN | 00001100 |
| | Mask 3 | 36 | H | LPSN-1 | 01111111 |
| F# | Mask 1 | 34 | H | LPSN | 00000000 |
| | Mask 2 | 35 | L | LPSN | 00001110 |
| | Mask 3 | 36 | H | LPSN-1 | 00111111 |
| G | Mask 1 | 34 | H | LPSN | 00000000 |
| | Mask 2 | 35 | L | LPSN | 00001111 |
| | Mask 3 | 36 | H | LPSN-1 | 00011111 |
| G# | Mask 1 | 34 | H | LPSN | 10000000 |
| | Mask 2 | 35 | L | LPSN | 00001111 |
| | Mask 3 | 36 | H | LPSN-1 | 00001111 |
| A | Mask 1 | 34 | H | LPSN | 11000000 |
| | Mask 2 | 35 | L | LPSN | 00001111 |
| | Mask 3 | 36 | H | LPSN-1 | 00000111 |
| A# | Mask 1 | 34 | H | LPSN | 11100000 |
| | Mask 2 | 35 | L | LPSN | 00001111 |
| | Mask 3 | 36 | H | LPSN-1 | 00000011 |
| B | Mask 1 | 34 | H | LPSN | 11110000 |
| | Mask 2 | 35 | L | LPSN | 00001111 |
| | Mask 3 | 36 | H | LPSN-1 | 00000001 |
| C | Mask 1 | 34 | H | LPSN | 11111000 |
| | Mask 2 | 35 | L | LPSN | 00001111 |
| | Mask 3 | 36 | H | LPSN-1 | 00000000 |

*LPSN = same octave as lowest played solo note
**LPSN-1 = octave below octave of lowest played solo note.

As with the 12-bit embodiment discussed above, it is necessary to consolidate the data for all played accompaniment keys. Two registers are needed for a twelve note octave, and therefore, the accompaniment note data in registers 27 to 33 of FIG. 6 must be ORed into two separate registers. The F to C data in registers 27 to 30 would be ORed into register 38, and the C# to E data in registers 31 to 33 would be ORed into register 39. Again, pointers are created to identify the bit position and registers of the lowest note played on the solo keyboard. The register pointer identifies which register the lowest played solo note is in, and accordingly serves to identify the register with which the first of the three masks is associated. The second and third masks are associated with the next adjacent lower registers. In addition, the register pointer identifies whether the register containing the lowest played solo note is an H type register or an L type register. The register type, combined with the bit position of the lowest played solo note, serves to uniquely identify the nomenclature of the lowest played solo note. This, in turn, enables the microprocessor to select the three masks associated with that nomenclature from Tabel 2.

When all of the foregoing data has been obtained, the fill-in notes are inserted into registers 20 to 26 in much the same way used in the 12-bit embodiment. The microprocessor identifies the first mask associated with the lowest solo note, which would be register 34 of FIG. 6, using the same example as discussed previously. Since register 34 is a type H register, it is ANDed with the H register portion of the ORed accompaniment data (i.e. register 38), and the result is ORed with the register containing the lowest played solo note (register 22 in the example; this does not add any new notes to the notes to be sounded). Similarly, the second mask (register 35 in the example) is ANDed with its corresponding ORed accompaniment data (register 39) and the result is ORed into register 25, the register below the register containing the lowest played solo note. In the example, this adds the note D5 to the notes to be sounded. Finally, the third mask (register 36) is ANDed with its corresponding ORed accompaniment data (register 38 again), and the result is ORed with the register two steps below the register containing the lowest played solo note, (register 21) thereby adding G4 and B4 to the notes to be sounded. Note that register 37 is not used for a mask when a note in the range F to C is the lowest played solo note. Conversely, register 34 is not used for a mask when a note in the range C#-E is the lowest played solo note.

Thus, the same fill-in notes (i.e. G4, B4, and D5) are generated in the 8-bit embodiment of the present invention as are generated in the 12-bit embodiment. Note, however, that the register manipulation required in the 8-bit embodiment is substantially more involved due to the fact that a full octave of data cannot be stored in a single register. This factor must be weighed against the difficulties associated with use of a 12-bit machine, since it may present countervailing problems.

A third embodiment of the present invention using a 16-bit microcomputer also can be used to provide fill-in means. In the 16-bit embodiment each register holds sixteen bits, making it possible to utilize a variation of either the 8-bit or 12-bit embodiments. Thus, the 8-bit embodiment can be utilized by combining the data from two of the 8-bit registers into a 16-bit register. Alternatively, the data from each 12-bit register can be stored in a 16-bit register with four bits left over for storage or transfer of other data, as appropriate. As a third alternative, the data for one and one-third octaves can be stored in each 16-bit register and appropriate masks constructed in a manner similar to the 8-bit embodiment in which the data for two-thrids or one-third of an octave is stored in each 8-bit register.

At this point, the microprocessor would enter its output routine and thereby cause the appropriate tone signals to be transmitted to the output system, as discussed above.

Finally, if space is not available in memory to store the masks given in Table 2 for the 8-bit embodiment of the present invention, it is possible to generate the necessary masks (as is done in the 12-bit embodiment). A program to generate the masks can take up less room than the masks themselves. An example of a suitable algorithm for generating the masks shown in Table 2 is given in FIG. 7.

Figure 7:
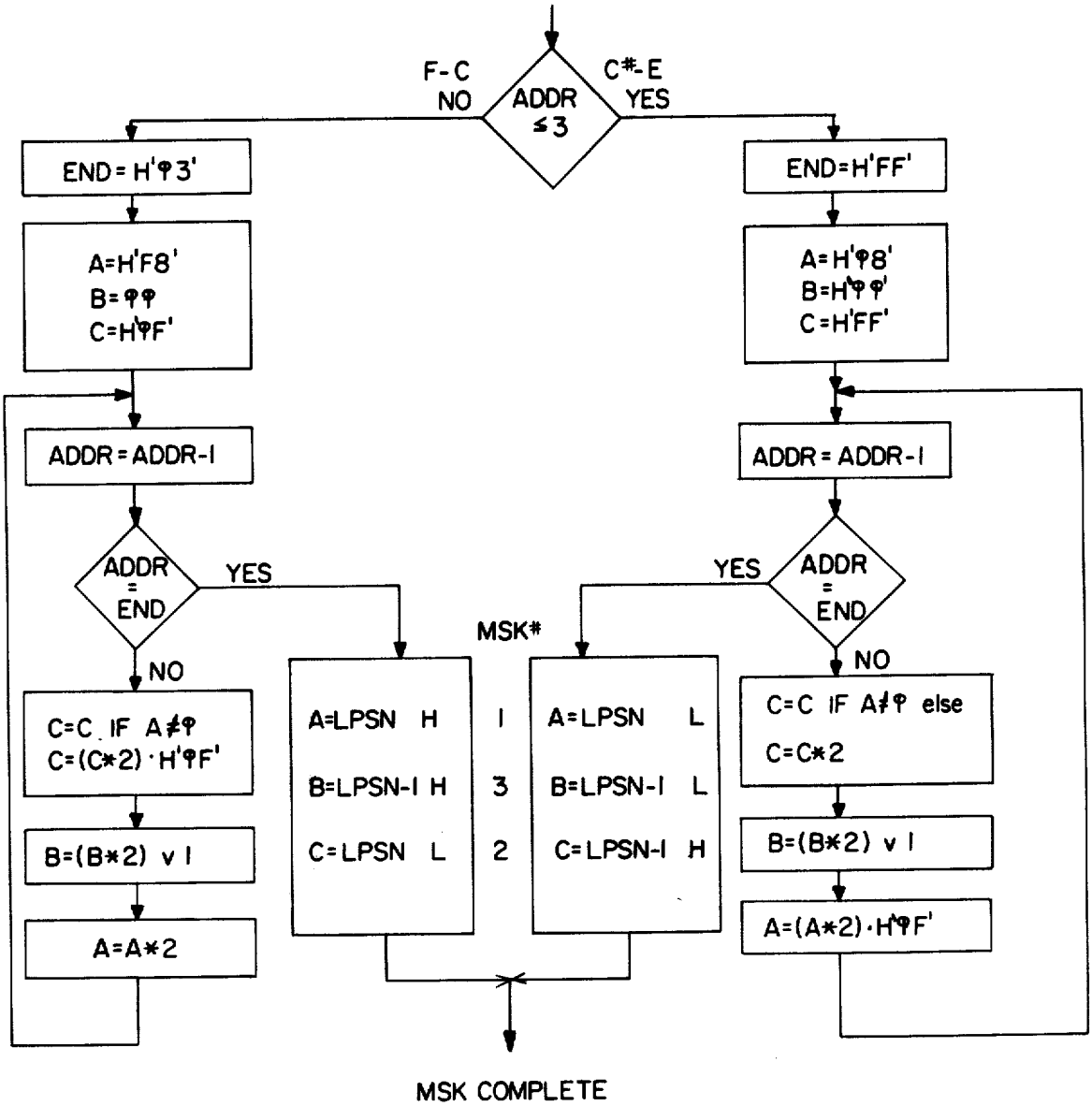
FIG. 7 is a flow chart showing one method of generating masks for use in the 8-bit embodiment of the present invention.

The first step in this implementation of the 8-bit embodiment of the present invention (as shown in FIG. 7) is to load the status of the keyswitches (as well as the control switches, if desired) into the memory of the microprocessor, in the manner previously described. If desired, the status of various control switches can be checked at this point to see if the fill-in feature has been overridden by selection of a different function. For example, if it is desired that selection of the percussion mode should supersede the operation of the fill-in mode, the percussion switch could be checked.

The next step is to establish a pointer, ADDR, which identifies the nomenclature of the lowest played solo note (with the notes E, D#, D . . . F being represented by values for the ADDR register of 0, 1, 2 . . . 11, respectively). If no solo note is detected, then there are no fill-in notes to be generated, and the gating of the generator signals to the audio system can proceed. If a solo note is detected, the next step is to compute the OR'ed accompaniment note data for registers 38 (i.e. reg 27 V reg 28 V reg 29 V reg 30) and 39 (i.e. reg 31 V reg 32 V reg 33) which are respectively designated as AORH and AORL. If both AORH=0 and AORL=0, no accompaniment notes have been played. In this case, no fill-in notes will be generated, and the gating of the generator signals to the audio system can proceed.

If AORH and AORL are not both zero, then three masks must be computed. The first step in the computation of the masks is to determine whether the lowest played solo note (which determines the masks) is in the C# to E range (i.e., ADDR=0-3) or the F to C range (i.e., ADDR=4-11).

If the value in the ADDR register is less than or equal to three, the END register is initialized to 'FF' (in hexadecimal), and register A, B, and C (which will hold the three masks) are initialized to '08', '00', and 'FF', respectively. The ADDR register is then decremented by 1. If the values in the END and ADDR registers are not equal, the A, B, and C registers are modified as follows: register A is shifted left and ANDed with 'OF'; if register A equals zero, register C is shifted left (otherwise register C is left unchanged); and register B is shifted left and ORed with '01'. The ADDR register is then decremented by one again. This continues until the ADDR register is equal to the END register. Masks A, B, and C are then complete.

If ADDR is not less than or equal to three, the END register is initialized to '03' (in hexadecimal), and registers A, B, and C are initialized to 'F8', '00', and '0F', respectively. The ADDR register is then decremented by 1. If the values in the END and ADDR registers are not equal, the A, B, and C registers are modified as follows: register A is shifted left; if register A=0, register C is shifted left and ANDed with 'OF' (otherwise register C is left unchanged); and register B is shifted left and ORed with 01. The ADDR register is again decremented by 1. This continues until the ADDR register is equal to the end register, at which point masks A, B, and C are complete.

Masks A, B, and C are generated in registers 35, 36, and 37 respectively, if the lowest played solo note is in the range C# to E; and in registers 34, 35, and 36, respectively, if the lowest played solo note is in the range F to C. The masks are then ANDed with the data in the AORH and AORL registers (i.e., registers 38 and 39), and the result is ORed with registers 20 to 33 as described above. The combined played note and fill-in note data thus generated is then used to control the transmission of generator signals to the audio system, as previously described.

If desired, the fill-in parameters can be modified to produce other desired musical effects. For example, the number of fill-in notes can be limited. It is also possible to change the manner in which the position at which the notes are to be filled in is specified. Since the parameters for the fill-in notes are specified in the microcomputer software, no hardware modifications are necessary to effect such changes. However, in all variations contemplated by the present invention, played notes are caused to sound in octaves other than those in which they are played, in a manner responsive to the position of a particular played note.

In addition to the "Pro" feature discussed above, three other types of fill-in are particularly suited for use with the present invention. These features are herein referred to as "Theater", "Duet", and "Country Harmonizer".

In the "Theater" mode, a maximum of two notes are filled in. The note which would be filled in immediately below the lowest played note on the solo keyboard (in the "Pro" mode) is filled in an octave lower than in "Pro". The second note (if any) below the lowest played solo note is sounded in the same octave in which it would be sounded in the "Pro" mode.

In the "Duet" mode, only one note is filled in. The first note below the lowest played solo note which would be filled in in the "Pro" mode is suppressed, and the second lower note (if any) below the lowest solo note is sounded in the same octave in which it would sound in the "Pro" mode.

Finally, in the "Country Harmonizer" mode, one of the notes which would be filled in below the lowest played solo note in the "Pro" mode is sounded in the octave above the highest played solo note. The selection of the note to be filled in the preferred embodiment of the present invention is made in accordance with the following criteria. For any arbitrary combination of played accompaniment notes, the country harmonizer note will be the highest note, the nomenclature of which falls into the range between five semitones and eight semitones (inclusive) above the highest played solo note. If more than one note satisfies this condition, then the highest acceptable note would be selected. If none of the accompaniment notes satisfies this condition, then the fourth semitone above the highest played solo note would be tried and failing that, the ninth semitone above the highest played solo note would be tried. Thus, for example, if the highest played solo note is a C, the accompaniment notes will be tested to see if any of them falls within the range from F to G#. If none of the played accompaniment notes satisfies this condition, the note E will be tried, followed by the note A. If none of these tests identify a note corresponding to a played accompaniment note, no country harmonizer note is filled in. The same test is used if the accompaniment note which has previously been selected for country harmony is dropped. However, when the highest played solo note is changed, the country harmonizer note will not be changed if the harmonizer note is within the range from two semitones through ten semitones above the highest played solo note. If this test is not satisfied, a new country harmonizer note is selected in accordance with the criteria stated above.

It can readily be seen that each of the foregoing effects can be implemented in accordance with the techniques described in detail above with reference to the "Pro" mode. Once the ORed accompaniment information has been generated, it can be added to the played note information (in whole or in part) in any specified octave (or octaves) by the selection of appropriate masks. However, in order to suppress or shift one or more of the notes which would be sounded in the "Pro" mode, it is desirable to be able to identify which would be the first, second, and third notes to be filled in the "Pro" mode. In this manner, for example, in the "Theater" mode, the first note can be shifted to a lower octave. This identification can be accomplished by a scanning routine as described below.

Referring to the twelve bit embodiment of the present invention, the organ accompaniment data which is stored in register number 10 can be searched starting from the position corresponding to the position of the lowest played solo note (skipping the two adjacent notes if desired) and recording the bit position of each played accompaniment note found. This information regarding the played accompaniment notes can be stored in separate registers in pitch order. Since only four accompaniment notes are used in the various fill-in modes described herein, only four such registers are provided. However, any number can be used if different effects are desired. Note that if the end of register number 10 (bit 11) is reached before four played accompaniment notes have been identified, the scan returns to bit zero and continues until the position of the lowest played solo note is reached, or until four played accompaniment notes have been found.

Figure 8:
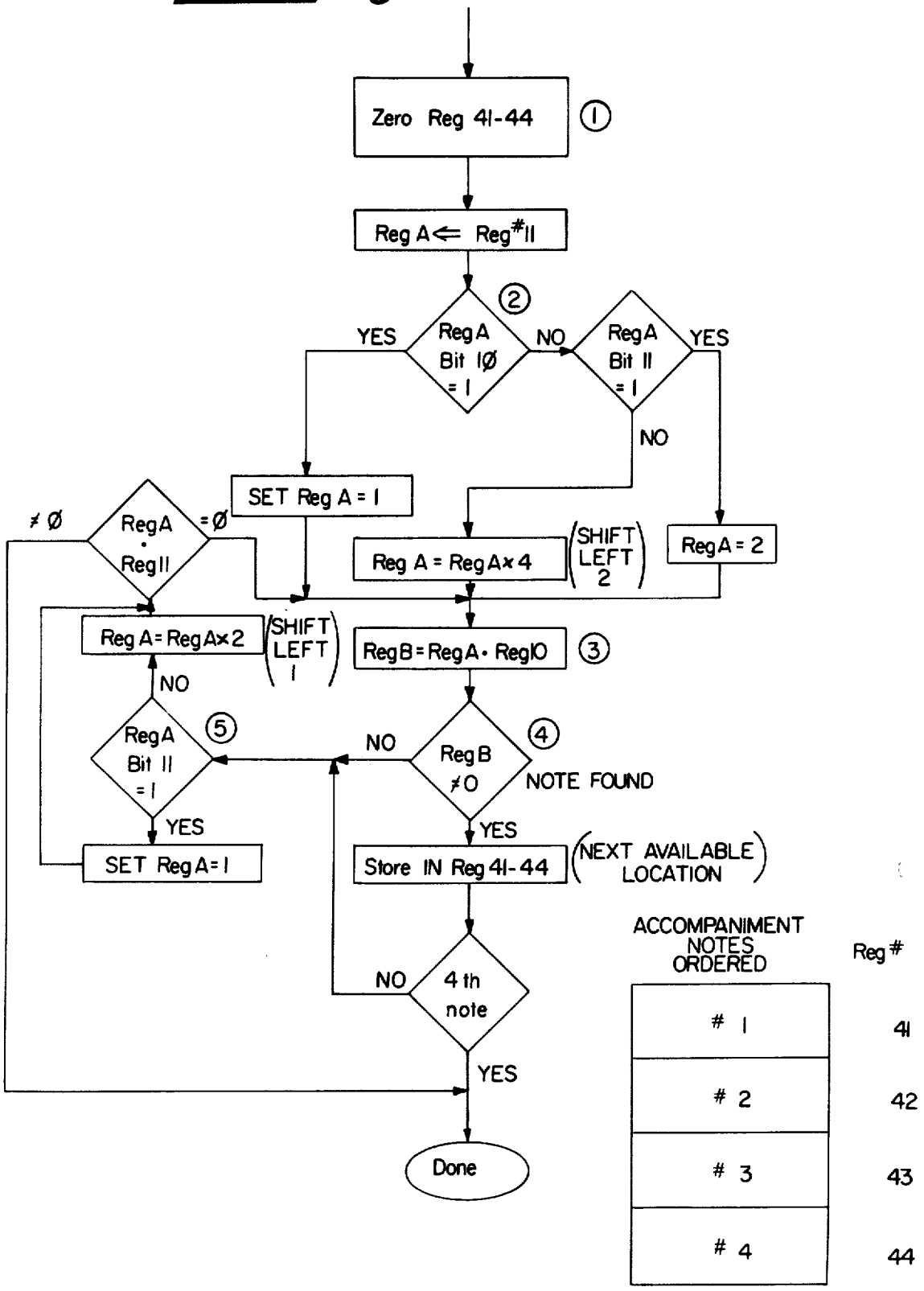
FIG. 8 is a flow chart showing a method for ordering the played accompaniment notes for use in certain embodiments of the present invention.

FIG. 8 shows a routine for obtaining the necessary segregation of the played accompaniment notes. At step one, four registers 41 to 44, which will hold the played accompaniment note information in pitch order, are initialized to zero. The contents of register 11 are then copied into working register A. At step two, bit 10 of register A is compared to one. If bit 10 of register A is equal to one, register A is set equal to one and the routine proceeds to step three. If bit 10 of register A is not equal to one, bit 11 of register A is compared to one. If bit 11 of register A is equal to one, then register A is set equal to two and the routine proceeds to step three. If bit 11 of register A is not equal to one then register A is shifted left two positions and the routine proceeds to step three. Thus, step two suppresses the two notes immediately below the lowest played solo note. At step three, register A is ANDed with register 10 and the result is put in working register B. At step four, register B is compared to zero. If register B is equal to zero, the contents of register B are stored in the first empty register of registers 41 through 44. If the first available register is register 44, then the note transferred from register B is the fourth accompaniment note, and the routine is complete. If the next available register is not register 44, the routine proceeds to step 5. At step five, bit 11 of register A is compared to one. If bit 11 of register A is equal to one, then register A is set equal to one. If bit 11 of register A is not equal to one, then register A is shifted left one position. In either case, register A is then ANDed with register 11. If the result is not equal to zero, then the routine is complete since there are no more accompaniment notes available. If the result is equal to zero, the routine branches back to step three and continues until four accompaniment notes have been identified and inserted into registers 41 through 44, or until the scan completes a cycle, indicating that fewer than four accompaniment notes are played. Once the identity of the up to four played accompaniment notes has been determined in accordance with the foregoing routine, the various fill-in effects described can readily be implemented.

It is also contemplated that certain of these four fill-in modes can be selected simultaneously. In particular, it has been found desirable to permit a combination of either the "Pro" or "Theater" mode with either the "Duet" or "Country Harmonizer" mode. When such combinations of modes are selected, an additional musical effect can be provided which would otherwise be unobtainable by a single performing musician. This additional feature assigns the notes produced by the "Pro" or "Theater" mode (if either is selected) to the flute stops (if any is selected); and the notes produced by the "Duet" or "Country Harmonizer" mode (if either is selected) to the nonflute stops of the organ such as the string and reed voices (if any is selected). With this feature, all of the played notes would of course sound in all selected voices. In addition, the notes filled in in accordance with either the "Pro" or "Theater" mode (if either is selected) would sound in the flute voice (if a flute voice is selected); and the notes filled in accordance with the "Duet" or "Country Harmonizer" mode (if either is selected) would be sounded in the nonflute voices of the organ (if any are selected). If only one of the four modes is selected, then the notes filled in by that mode are sounded in all selected voices, without regard to whether they are flute or nonflute voices.

This feature can readily be implemented utilizing the structure disclosed above as shown in FIG. 1. Some of the gates in gate matrix 140 would be associated with either "Pro" or "Theater" fill-in notes and played notes of the solo keyboard. Others of the gates in gate matrix 140 would be associated with the played notes and the fill-in notes of either the "Duet" or the "Country Harmonizer" mode. These two groups of gates would be associated respectively with the flute and nonflute filters of the audio output system 170. This effect can be further enhanced by incorporating separate amplifiers and electroacoustic transducers into the audio output system 170 for the flute and nonflute voices respectively.

While certain preferred embodiments of the present invention have been illustrated and described, a number of modifications and variations to the present invention are contemplated. In particular, it should be clear that the present invention is not limited to microprocessor controlled organ systems, but rather is applicable to any organ system wherein the identity of the notes to be sounded is stored in a digital memory device. It can readily be seen that the present invention can function regardless of the word size of the digital logic device which is used. In some applications, the use of more than one microprocessor may be desirable or necessary. In addition, the fill-in parameters can be varied in many ways to produce a wide variety of musical effects in addition to those described in detail above. Accordingly, the present invention is not limited to the precise construction disclosed herein, and encompasses all variations within the scope of the appended claims.

We claim:

1. A harmony generator for an electronic organ having at least one keyboard, a generator system, and an audio system, comprising:

storage means for storing data identifying all notes to be sounded by the organ;

input means for loading the storage means with played key data identifying the played keys of a keyboard;

fill-in means, responsive to at least one played key for identifying the nomenclatures of the fill-in notes and responsive to at least a second played key for identifying the octave in which the fill in notes are to be sounded, for generating fill-in data identifying notes to be filled in, and loading the fill-in data into the storage means; and output means for controlling the transmission of signals from the generator system to the audio system in accordance with the played key data and the fill-in data in the storage means.

2. A harmony generator for an electronic organ including a solo keyboard, an accompaniment keyboard, a generator system and an audio system comprising:

note register means for storing data regarding the identity of all notes to be sounded by the organ;

played note input means for loading the note register means with data regarding the played keys of the keyboards;

fill-in input means, responsive to at least one played key for identifying the nomenclatures of the fill-in notes and responsive to at least a second played key for identifying the octave in which the fill-in notes are to be sounded, for generating fill-in note data and loading the fill-in note data into the note register means; and output control means for causing signals to be passed from the generator system to the audio system in accordance with the data stored in the note register means.

3. A harmony generator for an electronic organ having a solo keyboard, an accompaniment keyboard, a generator system, and an output system, comprising:

storage means for storing data identifying all notes to be sounded by the organ;

input means for scanning the keyboards and loading the storage means with data identifying the played keys of the keyboards;

fill-in means for generating fill-in data identifying fill-in notes, said fill-in notes having the same nomenclatures as the keys played on the accompaniment keyboard and being in the octave below the lowest played note of the solo keyboard, and for loading the fill-in data into the storage means; and output means for controlling the transmission of signals from the generator system to the audio system in accordance with the played key data and the fill-in data in the storage means.

4. A harmony generator as claimed in claims 1, 2, or 3 wherein the fill-in means is a microcomputer.

5. A harmony generator as claimed in claims 1, 2, or 3 wherein the fill-in means is an 8-bit microcomputer.

6. A harmony generator as claimed in claims 1, 2, or 3 wherein the fill-in means is a 12-bit microcomputer.

7. A harmony generator as claimed in claims 1, 2, or 3 wherein the fill-in means is a 16-bit microcomputer.

8. A harmony generator for an electronic organ including a solo keyboard, an accompaniment keyboard, a generator system and an audio system comprising:

note register means for storing data regarding all notes to be sounded by the organ;

input means for loading the note register means with data regarding the played keys on the keyboards;

accompaniment data register means for storing data regarding the nomenclatures of the played keys of the accompaniment keyboard;

solo key register means for storing data regarding the identity of a particular played key of the solo keyboard;

fill-in means for determining the nomenclatures of the fill-in notes, and responsive to data from the solo manual stored in said solo key register means and to data from the accompaniment manual stored in said accompaniment data register means for determining the octave of each fill-in note and whether it is to be sounded, and for loading the fill-in data into the note register means; and output control means for causing generator signals to be passed to the audio system in accordance with the data in the note register means.

9. The harmony generator of claim 8, wherein the fill-in means further comprises:

mask generating means responsive to the data in the solo key register means for generating at least one mask; and means for combining the data in the accompaniment data register means with the at least one mask to obtain fill-in data.

10. The harmony generator of claim 8, or claim 9, wherein the solo key register means stores data regarding the identity of the lowest key played on the solo keyboard.

11. The harmony generator as claimed in claim 8 wherein said fill-in means further comprises:

mask generating means responsive to the data in the accompaniment data register means and the solo key register means for generating at least one mask; and means for combining the data stored in said accompaniment data register means with the at least one mask and with the data stored in said solo key register means, whereby data corresponding to the fill-in notes is obtained.

12. In an electronic organ including a solo keyboard, an accompaniment keyboard, a generator system and an audio system, an improved method of generating harmony comprising:

storing data regarding all played keys of the solo keyboard and the accompaniment keyboard in a played note storage means;

storing data regarding the nomenclatures of the played keys of the accompaniment keyboard in an accompaniment storage means;

storing data regarding the identity of a particular played key of the solo keyboard in a solo storage means;

generating fill-in data based on the data in the accompaniment storage means and the solo storage means;

storing the fill-in data with the data from the played note storage means in a note-to-be-sounded storage means; and controlling the transmission of generator signals from the generator system to the audio system in accordance with the data in the note-to-be-sounded storage means.

13. A harmony generator for an electronic organ having a solo keyboard, an accompaniment keyboard, a generator system, and an output system, comprising:

storage means for storing data identifying all notes to be sounded by the organ;

input means for scanning the keyboards and loading the storage means with data identifying the played keys of the keyboards;

fill-in means for generating fill-in data identifying at least one note to be filled in which corresponds to the nomenclatures of at least one of the played keys of the accompaniment keyboard, and which is located in the two octaves below the lowest played note of the solo keyboard, and for loading the fill-in data into the storage means; and output means for controlling the transmission of signals from the generator system to the audio system in accordance with the played key data and the fill-in data in the storage means.

14. A harmony generator as claimed in claim 13, wherein the fill-in means is a microcomputer.

15. A harmony generator as claimed in claim 13 wherein an accompaniment note is filled into the first octave below the octave of the lowest played solo note, said accompaniment note being of the same nomenclature as the second note chromatically lower than the lowest played solo note.

16. A harmony generator for an electronic organ having a solo keyboard, an accompaniment keyboard, a generator system, and an output system, comprising:

storage means for storing data identifying the notes to be sounded by the organ;

input means for scanning the keyboards and loading the storage means with data identifying the played keys of the keyboards;

fill-in means responsive to the highest solo note played for generating fill-in data identifying at least one fill-in note which corresponds to the nomenclature of at least one played key of the accompaniment keyboard, and which is located in the octave above the highest played note of the solo keyboard, and for loading the fill-in data into the storage means; and output means for controlling the transmission of signals from the generator system to the audio system in accordance with the played key data and the fill-in data in the storage means.

17. A harmony generator as claimed in claim 13 wherein an accompaniment note is filled into the second octave below the octave of the lowest played solo note, said accompaniment note being of the same nomenclature as the first note chromatically lower than the lowest played solo note.

18. A harmony generator for an electronic organ including a solo keyboard, an accompaniment keyboard, a generator system and an audio system for sounding notes in a plurality of voices, comprising:

note register means for storing data regarding the identity of each note to sounded by the organ;

played note input means for loading the note register means with data regarding all played keys of the keyboards;

fill-in input means, responsive to at least one played key for identifying the nomenclatures of the fill-in notes and responsive to at least one played key for identifying the octave in which the fill-in notes are to be sounded, for generating fill-in note data in accordance with a first set and a second set of fill-in criteria and loading the fill-in note data into the note register means; and output control means for causing signals to be passed from the generator system to the audio system in accordance with the data stored in the note register means, the fill-in notes satisfying the first set of fill-in criteria being voiced differently from the fill-in notes satisfying a second set of fill-in criteria.

19. In an electronic organ including a solo keyboard, an accompaniment keyboard, a generator system and an audio system, an improved method of generating harmony comprising:

storing data regarding all played keys of the solo keyboard and the accompaniment keyboard in a note storage means;

storing data regarding the nomenclatures of the played keys of the accompaniment keyboard in an accompaniment storage means;

storing data regarding the identity of a particular played key of the solo keyboard in a solo storage means;

generating fill-in data based on the data in the accompaniment storage means and the solo storage means;

adding the fill-in data to the data in the note storage means and storing the result in the note storage means; and controlling the transmission of generator signals from the generator system to the audio system in accordance with the data in the note storage means.

20. A harmony generator for an electronic musical instrument including a solo keyboard, an accompaniment keyboard, a tone generator system and an audio system for sounding tones produced by the tone generator system, comprising:

note register means for storing data corresponding to all notes to be sounded by the audio system;

accompaniment data register means for storing data corresponding to the nomenclatures of the played keys on the accompaniment keyboard;

solo data register means for storing data corresponding to a key played on the solo keyboard;

input means for identifying the keys played on the accompaniment keyboard and a key played on the solo keyboard and for loading data corresponding to the keys played in said note register, said input means also loading data into said accompaniment register means corresponding to the nomenclatures of the keys played on the accompaniment keyboard, said input means also loading into said solo data register means data corresponding to a key played on the solo keyboard;

fill-in means responsive to the data in said accompaniment data register means and said solo data register means for generating fill-in data corresponding to fill-in notes to be sounded, said fill-in means also loading said fill-in data into said note register means; and output control means responsive to the data stored in said note register means for causing signals from the generator system to be passed to the audio system and tones sounded corresponding to the data stored in said note register means, whereby tones are sounded corresponding both to the keys played on the accompaniment keyboard and the solo keyboard as well as to fill-in notes.

21. The harmony generator as claimed in claim 20 wherein said fill-in means for generating said fill-in data deletes fill-in data corresponding to a predetermined number of fill-in notes immediately below the note of the lowest played solo key.

22. The harmony generator as claimed in claim 20 wherein said input means identifies the lowest key played on the solo keyboard and loads data into said solo data register means corresponding to the lowest key played on the solo keyboard.

* * * * *